US005458292A

United States Patent [19]

Hapeman

[11] Patent Number: 5,458,292

[45] Date of Patent: Oct. 17, 1995

[54] TWO-STAGE FUEL INJECTION NOZZLE

[75] Inventor: Martin J. Hapeman, Edinboro, Pa.

[73] Assignee: General Electric Company, Erie, Pa.

[21] Appl. No.: 242,829

[22] Filed: May 16, 1994

[51] Int. Cl.[6] ..... F02M 43/04

[52] U.S. Cl. ..... 239/533.4

[58] Field of Search ..... 239/533.2–533.12

[56] References Cited

U.S. PATENT DOCUMENTS

| | | | |
|---|---|---|---|
| 3,232,540 | 2/1966 | Cassanmannago . | |
| 3,379,374 | 4/1968 | Mekkes . | |
| 4,095,747 | 6/1978 | Anderson . | |
| 4,202,500 | 5/1980 | Keiczek | 239/533.3 |
| 4,205,790 | 6/1980 | Keiczek | 239/533.4 |
| 4,215,821 | 8/1980 | Eblen | 239/533.4 |
| 4,225,088 | 9/1980 | Kulke et al. | 239/533.5 |
| 4,266,727 | 5/1981 | Happel et al. . | |
| 4,359,191 | 11/1982 | Uchida . | |
| 4,390,129 | 6/1983 | Uchida . | |
| 4,425,894 | 1/1984 | Kato et al. . | |
| 4,537,352 | 8/1985 | Kato et al. . | |
| 4,601,269 | 7/1986 | Kato et al. . | |
| 4,736,712 | 4/1988 | Savkar et al. . | |

FOREIGN PATENT DOCUMENTS

| | | | |
|---|---|---|---|
| 61-135979 | 6/1986 | Japan | 239/533.9 |
| 4-140468 | 5/1992 | Japan | 239/533.4 |
| 5-5471 | 1/1993 | Japan | 239/533.9 |
| 260584 | 1/1927 | United Kingdom . | |
| 87/06308 | 10/1987 | WIPO | 239/533.5 |

*Primary Examiner*—Karen B. Merritt

*Attorney, Agent, or Firm*—Jill M. Breedlove; Marvin Snyder

[57] ABSTRACT

A fuel injection nozzle has an outer body member and an inner body member, the inner body member being slidingly positioned in a secondary axially extending cavity in the outer body member and including a valve needle slidingly positioned in a primary axially extending cavity in the inner body member. The inner body member acts as a first fluid pressure actuated valve needle for injecting fluid between the inner member and the outer member when the inner member is displaced axially by fluid pressure. The valve needle acts as a second fluid pressure actuated valve member for injecting fluid through an extension of the second axially extending cavity when the valve needle is displaced axially by other fluid pressure. First fluid orifices extend through an end of the outer member for spraying fuel released by displacement of the inner body member. Second fluid orifices extend through an end of the inner member for spraying fuel released by displacement of the valve needle.

6 Claims, 2 Drawing Sheets

TWO-STAGE FUEL INJECTION NOZZLE

BACKGROUND OF THE INVENTION

The present invention relates to fuel injection nozzles for internal combustion engines and, more particularly, to a two-stage fuel injection nozzle for concentric fuel flow from two fuel inlet lines.

Internal combustion engines, particularly diesel engines, have long used fuel injection systems for injecting fuel into combustion chambers of an engine. Air drawn into the combustion chamber separate from the fuel is mixed with a spray of fuel from the injection nozzle and ignited to create a controlled explosion for driving a piston outward of the chamber to effect rotation of a drive shaft of the engine. The power output of the engine is varied by controlling the volume of fuel injected into its combustion chambers.

In some applications, for example, in a diesel electric locomotive, the engine may have nine-inch diameter combustion chambers and be required to operate at constant speed over a broad power range. At full power, the engine may generate 4000 HP or more. At idle, the engine may only be required to generate 400 HP. The broad range of power requirements creates difficulties in injector design. The injector openings or fuel exit passages must be large enough to allow fuel flow of sufficient quantity to accommodate the maximum required horsepower. However, at minimum horsepower, the openings are so large compared to the required fuel flow that the fuel "dribbles" or "streams" into the chamber rather than being sprayed or atomized. Both the combustion pattern and efficiency of the engine are detrimentally effected by the fuel streaming at low power. Accordingly, it would be advantageous to provide an injection nozzle which could produce an atomized spray at both high and low fuel flow rates. While one solution might be a variable aperture spray nozzle, it is not believed that such a device has been developed for this type application.

SUMMARY OF THE INVENTION

Among the several objects of the present invention may be noted the provision of a fuel injection nozzle for producing a fine fuel spray at relatively high and low fuel flow rates; the provision of a fuel injection nozzle which can inject two different type fuels either separately or jointly; and the provision of a fuel injection nozzle having separate fuel flow paths concentrically located in a common nozzle.

A fuel injection nozzle for injecting liquid fuel into a combustion chamber of an internal combustion engine comprises an outer body member having a cavity passing therethrough. One end of the cavity has a reduced diameter cylindrical portion and the cavity transitions to the cylindrical portion via a conical valve seat. An inner body member is slidably positioned in the cavity in the outer body member. The inner body member has a pair of axially spaced, circumscribing lands sealingly engaging inner walls of the cavity and defining a circumscribing fuel chamber therebetween. One end of the inner member terminates in a reduced diameter cylindrical extension extending through the cylindrical portion of the cavity. The inner member transitions to the reduced diameter extension via a conical valve seat adapted for sealingly engaging the valve seat in the outer member. The inner member includes a valve cavity passing axially therethrough and exiting adjacent an end of the extension. The valve cavity includes an internal valve seat at the extension. A spring means is positioned in the valve cavity and adapted for urging the inner member in a direction to seat the inner member valve seat against the valve seat in the outer member. A valve needle is slidably positioned in the valve cavity of the inner member and has a seating surface for sealingly seating against the internal valve seat in the valve cavity. A second spring means is positioned in the valve cavity and is adapted to urge the valve needle into a seating position on the internal valve seat. A first fluid passageway extends through the outer body member and terminates in the circumscribing fuel chamber. A second fluid passageway extends through the outer body member and terminates at the aperture in the outer body member between the pair of lands and the extension of the inner body member. A third fluid passageway extends through the inner body member and connects the circumscribing fuel chamber to the valve cavity adjacent the seating surface end of the valve needle. Pressurized fluid entering the first fluid passageway fills the circumscribing fuel chamber, flows through the third fluid passageway and reacts against the valve needle to displace the valve needle from the seating position to allow the fluid to be ejected through the aperture in the extension of the inner body member. Further, pressurized fluid enters the second fluid passageway and reacts against the inner body member to displace the inner body member from the conical valve seat to allow fluid in the second passageway to be ejected from the nozzle. Fuel in the first passageway can be at a lower pressure for actuating the valve needle while higher pressure fuel can be used to actuate both the valve needle and inner member.

BRIEF DESCRIPTION OF THE DRAWINGS

For a better understanding of the present invention, reference may be had to the following detailed description taken in conjunction with the accompanying drawings in which.

DETAILED DESCRIPTION OF THE INVENTION

Figure 1:
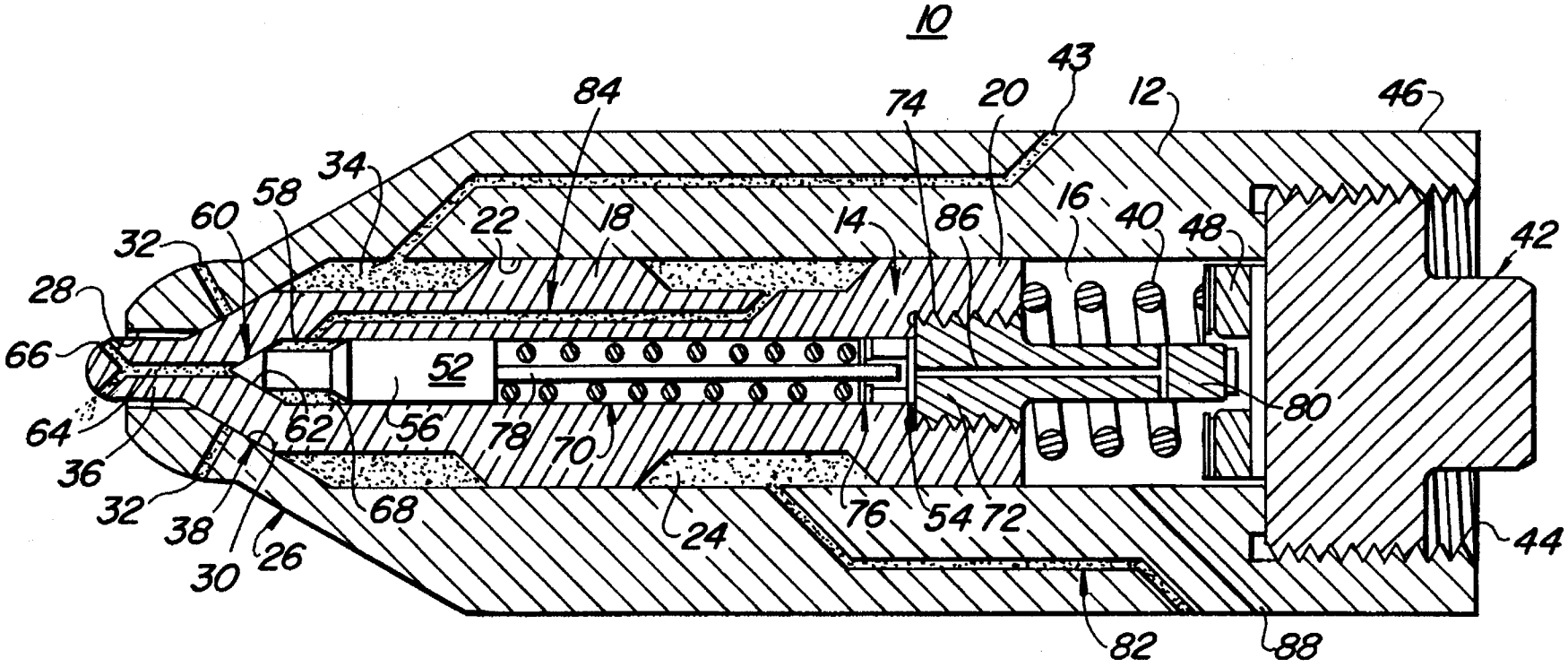
FIG. 1 is a cross-sectional view of a fuel injection nozzle in accordance with the present invention.

FIG. 1 illustrates one form of the present invention comprising a liquid fuel injection nozzle 10 having an outer body member 12 and an inner body member 14. The member 14 is positioned within an axially extending cavity 16 in outer member 12. Inner member 14 is guided within cavity 16 by a pair of spaced lands 18 and 20 on member 14 which are engaged in sliding contact with a surface 22 of cavity 16. The lands 18, 20 define a primary circumscribing fuel chamber 24 about member 14. At an end 26 of member 12, cavity 16 transitions from a relatively large diameter to a relatively small diameter aperture 28 extending through the end 26. The transition area defines a conically shaped valve seat 30 within cavity 16. A plurality of circumferentially spaced fuel injection passages 32 are formed in end 26 and extend from outside member 12 to the valve seat 30. A secondary circumscribing fuel chamber 34 is defined between the land 18 and the valve seat 30.

The end of member 14 and end 26 of member 12 are conically tapered to a reduced diameter extension 36 to form a mating valve seat 38 for engaging in sealing relationship with valve seat 30. The extension 36 extends through aperture 28 such that a small portion of extension 36 extends externally of member 12. The inner body member 14 is urged in a direction to seat valve seat 38 against valve seat 30 by a spring 40. The spring 40 is held against member 14 by a threaded insert 42 in an enlarged diameter threaded opening 44 in an end 46 of member 12 opposite the end 26. The spring 40 is preloaded to a desired compression to set the preload at valve seat 30 by use of shims 48 between the insert 42 and spring 40. Although illustrated as a threaded insert or stop member, it will be recognized that various means could be implemented to restrain spring 40, including an end plate or plug secured by a lock ring.

Considering only the operation of the inner member 14, which acts as a secondary valve needle, fuel is introduced under pressure through secondary fuel port 43 and fills secondary chamber 34. When the pressure of fuel in chamber 34 acting against land 18 at surface exceeds the preload spring force of spring 40, member 14 will be pushed axially toward spring 40, unseating member 14 against valve seat 30 and allowing fuel from chamber 34 to flow by seat 30. Some fuel will be forced outward through exposed passages 32 and some will be forced outward around extension 36 through aperture 28. This fuel injection process is referred to as the secondary fuel injection process since it is designed to occur at higher engine power operation when a higher volume of fuel is required and supplements the primary fuel supply.

Primary fuel flow is controlled or provided in nozzle 10 by a primary valve needle 52 slidingly positioned in an axially extending cavity 54 within inner body member 14. Valve needle 52 comprises an enlarged diameter section 56 sized to fit snugly in cavity 54 both to guide the valve needle and to provide a seal to limit fuel leakage. The valve needle further includes a reduced diameter end 58 terminating in a conically shaped valve seat 60. The cavity 54 also tapers to form a conical valve seat 62 for mating with seat 60. An aperture 64 extends from centrally of seat 62 through extension 36 terminating in a plurality of circumferentially spaced fuel openings 66 in extension 36. A fuel chamber 68 is defined about the reduced diameter end 58 of valve needle 52 within cavity 54. The valve needle 52 is held in seating position on valve seat 62 by a coil spring 70, which spring 70 is captured against valve needle 52 by a threaded insert 72 engaged in a threaded opening 74 in member 14, although any suitable end cap or insert may be used to restrain spring 70. The spring 70 is preloaded by use of shims 76 positioned between spring 70 and insert 72. If desired, the valve needle 52 may include a shaft portion 78 extending through spring 70 to guide and retain alignment of spring 70. Note also that insert 72 may be formed with an extending shaft 80 on which spring 40 is positioned.

In operation of the primary fuel flow system, particularly for lower engine power operation, fuel is introduced under pressure through port 82 and flows into primary chamber 24. Another port 84 extends from chamber 24 through inner member 14 to chamber 68. When fuel pressure in chamber 68 overcomes the seating force created by spring 70, valve needle 52 is axially displaced allowing fuel to flow from chamber 68 through aperture 64 and be injected into an associated combustion chamber through openings 66. The secondary system described above is operable at higher pressures or could be used to inject a different type of fuel into an engine.

The sealing engagement between lands 18, 20 and an inner surface 22 of cavity 16 is not considered leak-proof since member 14 should not bind in cavity 16. Fuel leaking past land 20 accumulates in the volume area around spring 40. Similarly, section 56 of valve needle 52 does not fully seal and fuel can accumulate in the volume area about spring 70. In the latter case, passage 86 is formed in insert 72 providing a flow path from the area of spring 70 to the area of spring 40. Thus, all leakage fuel eventually accumulates about spring 40. A drain port 88 extends through outer member 12 into the area of spring 40 to allow leakage fuel to be ported out and recycled.

Any leakage of primary fuel past the primary needle 52 collects in the primary spring chamber about spring 70 and then is directed through passage 86 in the extension portion 80 of insert 72. Primary fuel then tends to fill the secondary spring chamber about spring 40, along with primary fuel leaking through the annular clearance space between the secondary needle or inner member 14 and main body member 12. The leakage fuel then is ported out of the main body at port 88, where it can be collected and recycled. So long as the pressure in annular chamber 24, which is filled with the primary fuel, is maintained at higher pressure than that in annular chamber 34, which is filled with the secondary fuel, there can be no leakage of the secondary fuel into the primary fuel. If this condition be imposed, then, the leaked fuel collected at port 88 will all be of the primary type, uncontaminated by secondary fuel. Note that there will be leakage of primary fuel from annular chamber 24 to chamber 34 which is filled with secondary fuel. This contamination is of no consequence as it is injected directly into the combustion chamber where mixing of the fuel would occur in any case. While this arrangement is convenient in requiring only a single collection port 88, it will be apparent that the different fuel chambers at springs 40 and 70 could be individually ported to external collection areas.

The foregoing applies equally well to the application of a single fuel type. At low flow rates, all of the fuel would be directed to port 82 and injected via the primary needle 52. Nozzle holes 66 could be sized to provide good spray patterns at low flow rates. At higher flow rates, the additional fuel would be directed to port 43. Operation would then be spread over two ranges, thus providing increased opportunity for nozzle spray optimization than is currently possible with the single stage nozzle.

Figure 2:
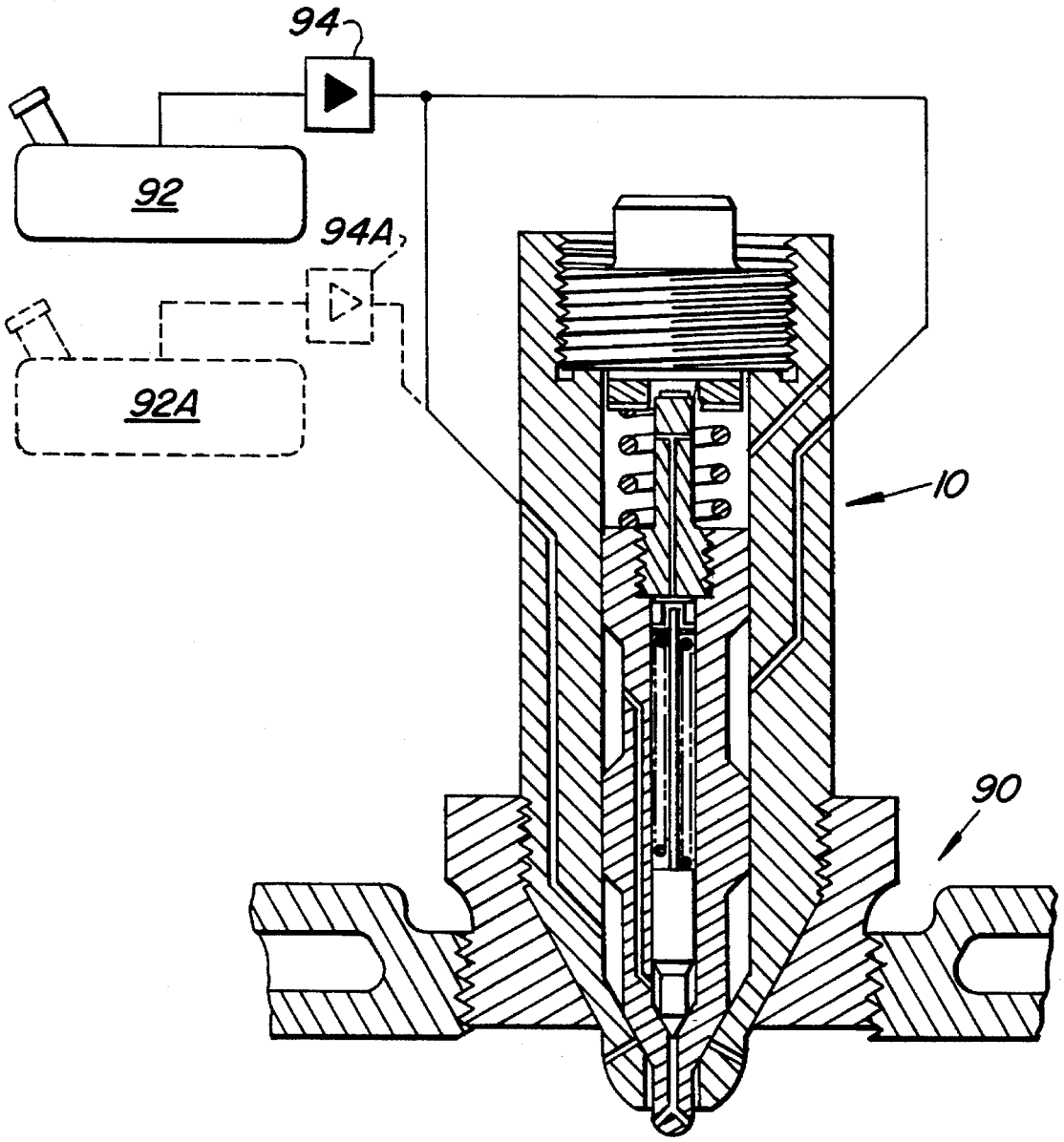
FIG. 2 a simplified diagram of a fuel system using the nozzle of FIG. 1.

FIG. 2 illustrates one manner in which the nozzle 10 may be used. The nozzle 10 is mounted in a cylinder head 90 of an internal combustion engine (not shown) such as a diesel engine of a well known type used in such applications as locomotive propulsion. Such engines can generate several thousand horsepower and therefore require a broad range of fuel flow. Fuel can be supplied from a single tank 92 via a single broad pressure range pump 94 or from two separate tanks 92, 92A with separate pumps 94, 94A if different type fuels are used.

While the invention has been described in what is presently considered to be a preferred embodiment, many variations and modifications will become apparent to those skilled in the art. Accordingly, it is intended that the invention not be limited to the specific illustrative embodiment but be interpreted within the full spirit and scope of the appended claims.

What is claimed is:

1. A fuel injection nozzle for injecting liquid fuel into a combustion chamber of an internal combustion engine, the nozzle comprising:

an outer body member having a secondary cavity passing therethrough, one end of said secondary cavity having a reduced diameter cylindrical portion, said secondary cavity transitioning to said cylindrical portion via a conical valve seat;

an inner body member slidably positioned in said secondary cavity in said outer body member, said inner body member having a pair of axially spaced, circumscribing lands sealingly engaging inner walls of said secondary cavity and defining a circumscribing fuel chamber therebetween, one end of said inner member terminating in a reduced diameter cylindrical extension extending through said cylindrical portion of said secondary cavity, said inner member transitioning to said reduced diameter extension via a conical valve seat adapted for sealingly engaging said valve seat in said outer member, said inner member including a primary cavity passing axially therethrough and exiting adjacent an end of said extension through an aperture, said primary cavity including an internal valve seat at said extension;

a spring means positioned in said secondary cavity and adapted for urging said inner member in a direction to seat said inner member valve seat against said valve seat in said outer member;

a valve needle slidably positioned in said primary cavity of said inner member and having a seating surface for sealingly seating against said internal valve seat in said primary cavity;

a second spring means positioned in said primary cavity and adapted to urge said valve needle into a seating position on said internal valve seat;

a first fluid passageway extending through said outer body member and terminating in said circumscribing fuel chamber;

a second fluid passageway extending through said outer body member and terminating at said secondary cavity between said pair of lands and said extension of said inner body member;

a third fluid passageway extending through said inner body member and connecting said circumscribing fuel chamber to said primary cavity adjacent said seating surface of said valve needle; and whereby pressurized fluid entering said first fluid passageway fills said circumscribing fuel chamber, flows through said third fluid passageway and reacts against said valve needle to displace said valve needle from its seating position to allow the fluid to be ejected through said aperture in said extension of said inner body member, and further whereby pressurized fluid entering said second fluid passageway reacts against said inner body member to displace said inner body member from said conical valve seat to allow fluid in said second passageway to be ejected from said nozzle.

2. A fuel injection nozzle for injecting liquid fuel into a combustion chamber of an internal combustion engine, the nozzle comprising:

an outer body member and an inner body member, said inner body member slidingly positioned in an axially extending secondary cavity in said outer body member, a first valve seat formed at one end of said secondary cavity and a mating seat formed on an adjacent end of said inner body member, a spring member positioned for reacting against an opposite end of said inner body member for urging said inner body member into seating engagement with said first valve seat;

a valve needle slidably positioned in an axially extending primary cavity in said inner body member, a second valve seat formed at an end of said primary cavity in said inner body member and a spring member positioned for reacting against an opposite end of said valve needle for urging said valve needle into seating engagement with said second valve seat;

first fuel injection openings extending through said outer body member and into an area proximate said first valve seat;

second fuel injection openings extending through said inner body member and into an area proximate said second valve seat; and means for independently supplying fuel to said secondary cavity and said primary cavity, passage of fuel through each of said first and second valve seats to respective ones of said first and second fuel injection openings being controlled by fuel pressure in corresponding ones of said cavities.

3. A fuel injection nozzle having an outer body member and an inner body member, said inner body member being slidingly positioned in a secondary axially extending cavity in said outer body member, and including a valve needle slidingly positioned in a primary axially extending cavity in said inner body member, said inner body member acting as a first fluid pressure actuated valve needle for injecting fluid between said inner member and said outer member when said inner member is displaced axially by fluid pressure, said valve needle acting as a second fluid pressure actuated valve member for injecting fluid through an extension of said primary axially extending cavity when said valve needle is displaced axially by fluid pressure, first fluid orifices extending through an end of said outer member for spraying fuel released by displacement of the inner body member and second fluid orifices extending through an end of said inner member for spraying fuel released by displacement of the valve needle.

4. The fuel injection nozzle of claim 3 and including first spring means positioned in said outer body member and abutting against said inner body member for urging said inner body member axially toward said first fluid orifices for preventing fuel flow therethrough when fuel pressure is less than a first predetermined pressure.

5. The fuel injection nozzle of claim 4 and including second spring means positioned in said primary axially extending cavity and abutting against said valve needle for urging said valve needle axially toward said second fluid orifices for preventing fuel flow therethrough when fuel pressure is less than a second predetermined pressure, said second predetermined pressure being less than said first predetermined pressure.

6. The fuel injection nozzle of claim 5 and including means for collecting leakage fuel leaking around said valve needle and said inner body member.

* * * * *